US008283016B2

(12) United States Patent
Slootweg et al.

(10) Patent No.: US 8,283,016 B2
(45) Date of Patent: Oct. 9, 2012

(54) ARTIFICIAL GRASS FIBRE AND ARTIFICIAL LAWN THEREOF

(75) Inventors: Geurt Bastiaan Slootweg, Enschede (NL); Frederik Jan Van Der Gaag, Nijverdal (NL); Marinus Hendrikus Olde Weghuis, Oldenzaal (NL)

(73) Assignee: Ten Cate Thiolon, B.V., Nijverdal (NL)

( * ) Notice: Subject to any disclaimer, the term of this patent is extended or adjusted under 35 U.S.C. 154(b) by 547 days.

(21) Appl. No.: 12/311,986

(22) PCT Filed: Oct. 23, 2007

(86) PCT No.: PCT/NL2007/000270

§ 371 (c)(1),
(2), (4) Date: Apr. 29, 2009

(87) PCT Pub. No.: WO2008/051073

PCT Pub. Date: May 2, 2008

(65) Prior Publication Data

US 2009/0252900 A1 Oct. 8, 2009

(30) Foreign Application Priority Data

Oct. 23, 2006 (NL) ..... 1032719

(51) Int. Cl.
*B32B 33/00* (2006.01)
*B32B 3/02* (2006.01)
*A41G 1/00* (2006.01)

(52) U.S. Cl. ..... 428/89; 428/17; 428/88; 428/97

(58) Field of Classification Search ..... 428/17, 428/97, 373, 374, 89, 88
See application file for complete search history.

(56) References Cited

U.S. PATENT DOCUMENTS 3,611,699 A 10/1971 Wininger, Jr. et al.
(Continued)

FOREIGN PATENT DOCUMENTS

JP 07-310250 5/1994
(Continued)

*Primary Examiner* — Cheryl Juska
(74) *Attorney, Agent, or Firm* — Olson & Cepuritis, Ltd.

(57) ABSTRACT

The invention relates to an artificial grass fiber in particular for use in an artificial mat for an artificial lawn, which artificial grass fiber is made of at least one synthetic material. The invention also relates to an artificial mat, in particular for use in an artificial grass sports field, which artificial mat is built up of a carrier to which at least artificial grass fibers according to the invention are attached. The object of the invention is therefore to provide an improved artificial grass fiber which on the one hand can be produced by means of the existing techniques and which on the other hand reduces the number of injuries on the field. According to the invention, the artificial grass fiber to that end furthermore comprises at least one additional material component, which additional material component imposes a permanent volume increase on the artificial grass fiber under the influence of an external stimulus after the artificial mat has been provided with the artificial grass fiber. Thus it is possible to create an artificial mat for a lawn, which can be produced by means of the standard production techniques and wherein the artificial grass fiber in question foams and transforms into, for example, a dampening layer after the manufacture of the artificial lawn, which layer improves or influences the playing characteristics of the sports field, such as the absorption of shocks, the restition of energy, the vetical deformation, grip and ball bounce and which furthermore reduces the number of player injuries.

12 Claims, 4 Drawing Sheets

U.S. PATENT DOCUMENTS

| | | | | |
|---|---|---|---|---|
| 3,686,046 | A * | 8/1972 | Crowley | 156/72 |
| 3,694,873 | A * | 10/1972 | Crowley | 264/103 |
| 3,847,719 | A * | 11/1974 | Crowley | 428/89 |
| 6,221,486 | B1 * | 4/2001 | Soane et al. | 428/364 |
| 6,387,492 | B2 * | 5/2002 | Soane et al. | 428/376 |
| 6,753,049 | B2 | 6/2004 | DeVries | |
| 6,955,841 | B2 | 10/2005 | Weghuis et al. | |
| 7,611,763 | B2 * | 11/2009 | Atsma et al. | 428/97 |
| 2005/0238823 | A1 | 10/2005 | Weghuis et al. | |
| 2010/0021660 | A1 * | 1/2010 | Slootweg et al. | 428/17 |
| 2010/0040808 | A1 * | 2/2010 | Van Der Gaag et al. | 428/17 |

FOREIGN PATENT DOCUMENTS

| | | |
|---|---|---|
| JP | 07-155280 | 6/1995 |
| JP | 07-329210 | 12/1995 |
| WO | WO2008/051072 A2 | 5/2008 |

* cited by examiner

2'
10
2
1
2"
(a)
2'
2
10
2"
1
i
ii
iii
(b)

ARTIFICIAL GRASS FIBRE AND ARTIFICIAL LAWN THEREOF

This application is the U.S. National Stage of International Application No. PCT/NL2007/000270 filed Oct. 23, 2007, the entire disclosures of which are incorporated herein by reference.

The invention relates to an artificial grass fibre in particular for use in an artificial mat for an artificial lawn, which artificial grass fibre is made of at least one synthetic material.

The invention also relates to an artificial mat, in particular for use in an artificial grass sports field, which artificial mat is built up of a carrier to which at least artificial grass fibres according to the invention are attached.

Synthetic materials are currently used for all kinds of purposes, in particular the use of all kinds of synthetic materials in artificial lawns for sports fields has experienced a strong growth the last few years. The development of artificial grass fibres and of artificial grass sports fields derived therefrom has expanded to such an extent that it is now possible to install artificial grass sports fields which are hardly distinguishable from natural grass sports fields as regards their appearance but in particular as regards their playing characteristics.

The last few years researchers have focussed in particular on the development of artificial grass fibres for use in artificial lawns for sports fields, taking into account in their research the fact that each individual sport has its own specific requirements as regards the subsoil and the surface properties of the material.

Standard synthetic materials that are currently used in the development of artificial grass fibres are polypropylene, polyamide and/or polyethylene. The advantage of such materials is that they can be produced at low cost and are easy to process, and that said synthetic materials can be readily processed into artificial grass fibres by stretching. Said fibres having a specific length are attached to a carrier, for example by tufting or another manufacturing technique. A drawback of the present artificial grass fibres in comparison with natural grass fibres is that the risk of injury resulting from the higher frictional resistance between the players' skin and the artificial grass fibres is much greater.

This latter drawback is currently obviated to a large extent by the use of a granular infill, such as rubber or plastic grains, between the synthetic grass fibres, as is for example disclosed in WO 2005/124028. These infilled grains not only provide a softer, damping playing surface on which players are less prone to injury, therefore, but they also provide optimised playing characteristics resembling those of natural grass. The use of an infill in artificial grass sports fields has a number of drawbacks, however. Not only is the installation of such an artificial grass sports field more labour-intensive, but an infilled artificial grass sports field requires maintenance also after it has been installed.

The past few years a number of non-infill systems have been introduced as alternatives, as for example disclosed in WO 01/96664 and US 2003/099787.

Recent research has been based on combining existing techniques with new developments in order to come to a non-infill system having more easily controllable playing characteristics than the current non-infill systems. These developments in particular relate to the combining of components and fibres of different length, diameter, shape and/or made of different synthetic materials, wherein one fibre is conducive to good playing characteristics, such as the roll of the ball, and the other fibres provide more grip and reduce the frictional resistance or provide shock absorption and energy restitution so as to reduce the risk of injury in this way.

A suitable combination of components and techniques is based on an analysis of the construction of the overall artificial grass system, wherein the system is defined in several layers, viz. an upper layer, a middle layer and a bottom layer. Each system layer is responsible for a part of the functional characteristics of the overall system. The upper layer is mainly responsible for the visual aspects of the sports field, but also, for example, for enabling safe sliding tackles and the correct roll of the ball. The middle layer is responsible mainly for the players' grip on the field, the stability and the low impact shock absorption (ball bounce). In addition to that, the bottom layer is responsible mainly for the high impact absorption (player-field interaction). Furthermore, a suitable balance between shock absorption and energy restitution is an important functional requirement. These are characteristics which, during a later stage in the research, must be translated into techniques and components to be used.

The object of the invention is therefore to provide an improved artificial grass fibre which on the one hand can be produced by means of the existing techniques and which on the other hand reduces the number of injuries on the field by integrating the functionalities of multiples system layers and can thus replace the infill material. According to the invention, the artificial grass fibre to that end furthermore comprises at least one additional material component, which additional material component imposes a permanent volume increase on the artificial grass fibre under the influence of an external stimulus after the artificial mat has been provided with the artificial grass fibre. Thus it is possible to create an artificial mat for a lawn, which can be produced by means of the standard production techniques and wherein the artificial grass fibre in question foams and transforms into, for example, a dampening layer after the manufacture of the artificial mat, which layer improves or influences the playing characteristics of the sports field, such as the absorption of shocks, the restition of energy, the vertical deformation, grip and ball bounce and which furthermore reduces the number of player injuries.

In a functional embodiment, the additional material component is homogeneously distributed in the artificial grass sports fibre. This makes it possible to influence the eventual construction and the appearance of the transforming artificial grass sports fibre in the artificial grass sports field.

In a specific embodiment, the additional material component is a foam material. The foam material may for example be composed of a mixture consisting of at least one or several polymeric materials combined with at least one chemical blowing agent that is compatible with said mixture. Examples of chemical foam materials (also called blowing agents) that are suitable for use in the present invention are Azo, Hydrazide, Carbazides, Tetrazoles, Nitroso compounds and carbonates. The process conditions and the correct blowing agent or combination of blowing agents are interdependent and must thus be selected to match. Catalysts may be added to the mixture, which catalysts influence the moment of activation of the blowing agents in order to thus optimise the process for obtaining a volume-increasing artificial grass fibre.

More specifically, the foam material has a closed cell structure after the permanent volume increase, which is preferable to an open cell foam structure. A closed cell structure has a longer life in relation to, for example, the weather conditions (for example dirt, sub-zero temperatures and moisture), so that the playing characteristics of the artificial grass sports field will remain the same, irrespective of the season and the presence of dirt and also irrespective of the weather conditions. According to the invention, a crosslinked artificial grass sports fibre is a more durable artificial grass sports fibre, which will furthermore not easily wear out rapidly or split as a result of being played on. On the other hand, the carrier may be formed of a crosslinked fibre as well.

In another embodiment of the invention, the synthetic grass fibre is an extruded fibre, so that the fibre can be produced by means of the known production techniques. The extruded artificial grass fibre can be formed by co-extruding said at least one synthetic material and said additional material component, whilst in another embodiment said at least one synthetic material surrounds said additional material component. In another functional embodiment, the extruded synthetic grass fibre can be formed by co-extruding said at least one synthetic material, said additional material component and a second synthetic material.

With these embodiments, different configurations of synthetic grass sports fibres having different playing characteristics can be realised, depending on the materials used in the (co-) extrusion process, According to the invention, the synthetic grass sports fibre may furthermore be composed in such a manner that the additional material component imposes the permanent volume increase on the fibre under the influence of heat.

The invention will now be explained in more detail with reference to the drawing, in which:

FIGS. 1 and 2 schematically show a few embodiments of an artificial lawn and in particular an artificial grass sports field comprising an artificial grass fibre;

Figure 1:
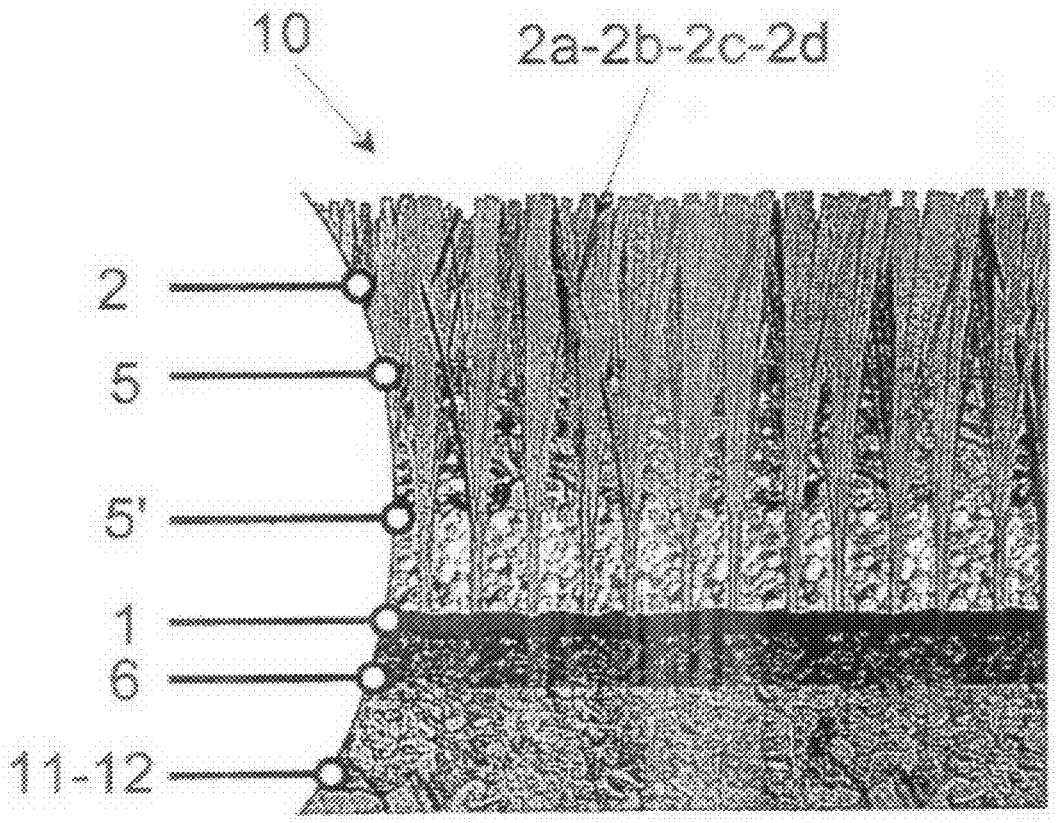
Figure 2:
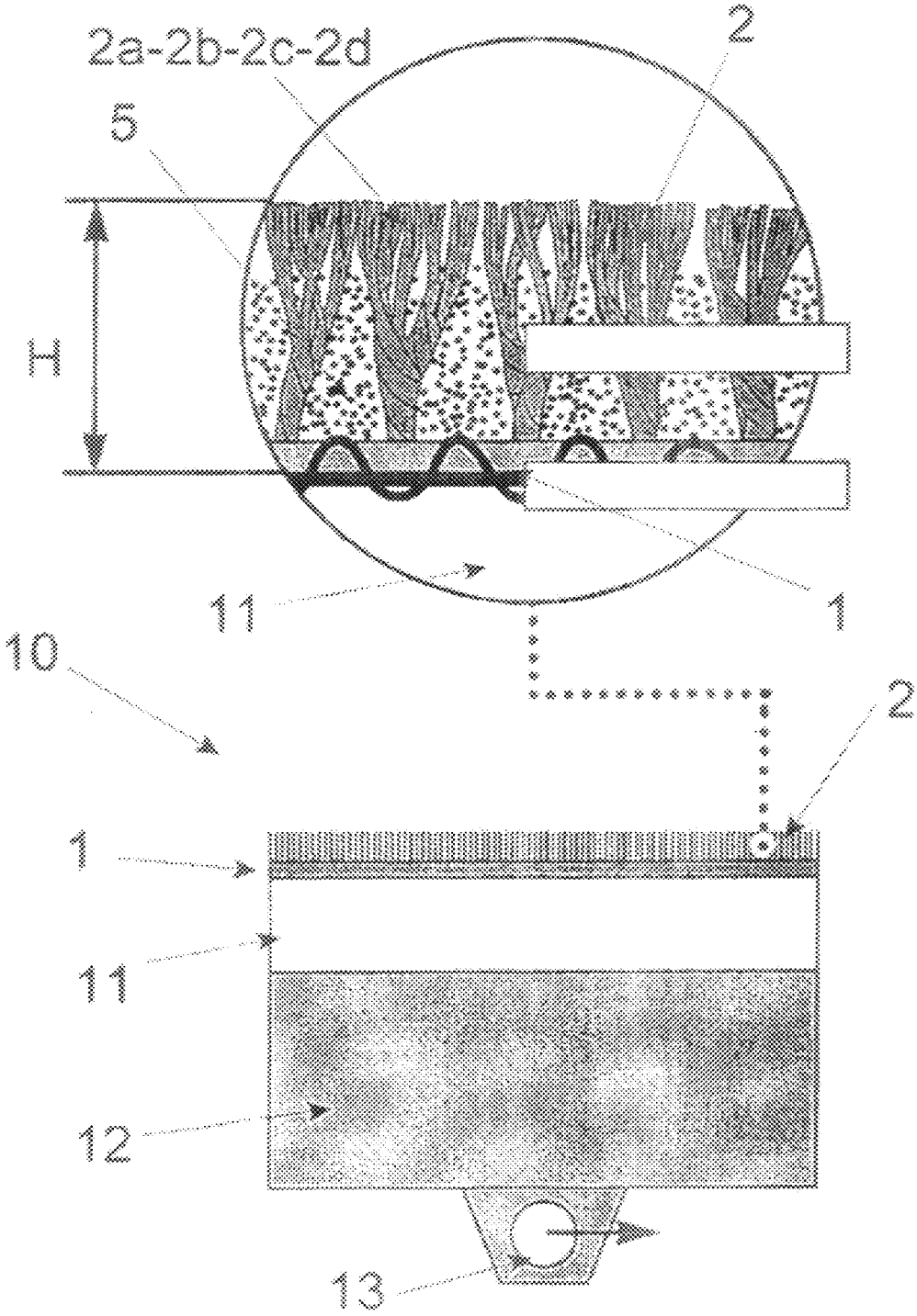

FIGS. 1 and 2 show embodiments of a known artificial lawn 10, in which a standard artificial grass fibre can be used. In both figures the artificial lawn 10 is provided with an artificial mat comprising a carrier 1, to which several artificial grass fibres 2 have been attached, for example by tufting. However also other techniques for manufacturing an artifical mat composed of a carrier with artificial fibres are possible.

The artificial grass fibres are generally made up of one or more artificial grass fibres 2*a*-2*b*-2*c*-2*d*-etc, which artificial grass fibres may consist of fibrillated and/or monofilament fibres, for example as described in International patent application WO 2004/077914. This makes it possible to create artificial grass substantially fully resembling natural grass. Such fibres 2*a*-2*d* can be produced by means of known production techniques, such as extrusion. The individual fibres 2*a*-2*d* thus obtained, for example by extrusion, can be twined to form the artificial grass fibre 2 and subsequently be attached to the carrier 1.

In FIGS. 1 and 2 the carrier is placed on a surface having additional sports-related properties, which surface is made up of the layers 6-11-12 and 13. The layer 11 may comprise an optional elastic layer 6 (said optional layer 6 may also form part of the carrier 1). The layers 11 and 12 form the foundation of the artificial lawn 10 and are built up of a coarse layer 11 of stones and a fine layer 12 of sand. The artificial lawn system 10 is provided with a drainage system, indicated at 13 in FIG. 2, for draining rain water.

An infill material 5 is provided between the artificial grass (sports) fibres, which infill may optionally be layered, as shown in FIG. 1, viz. a layer 5 of rubber or plastic grains and a layer 5' of sand grains.

Figure 3:
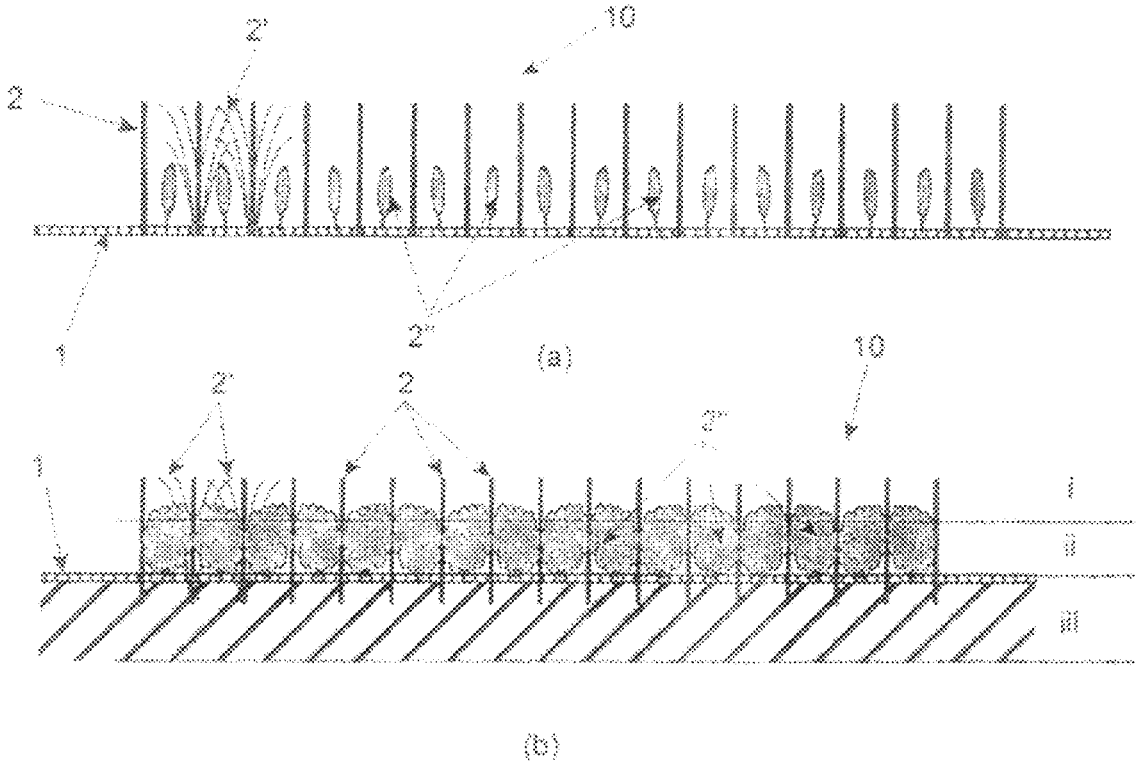
FIG. 3 is a detail view of an embodiment of an artificial grass fibre according to the invention.
Figure 4:
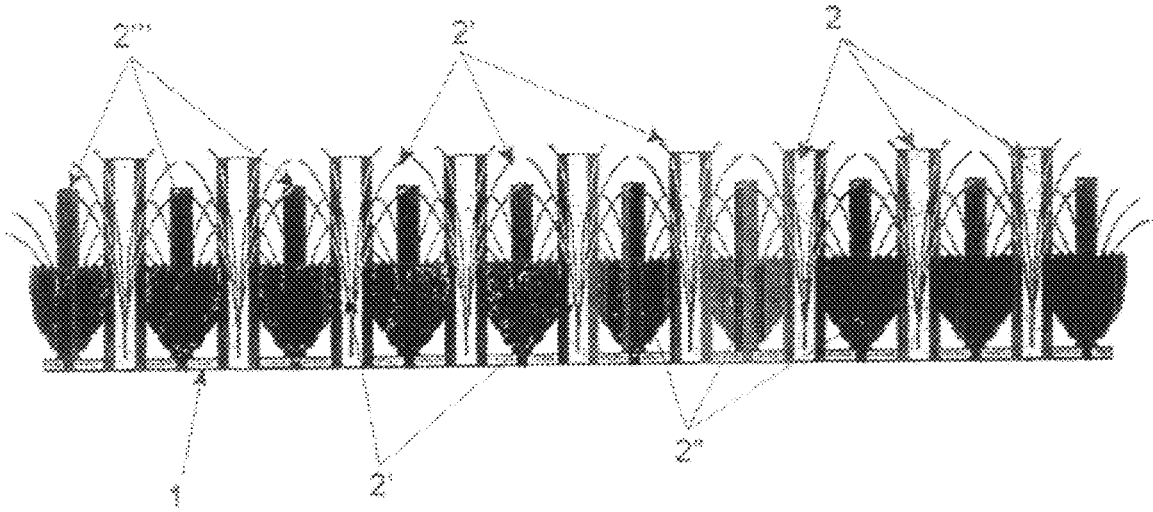
FIG. 4 is a detail view of another embodiment of an artificial grass fibre according to the invention.

FIGS. 3 and 4 show two embodiments of the artificial grass sports field according to the invention. Analogously to FIGS. 1 and 2, this embodiment comprises an artificial mat composed of a carrier 1, to which several groups of artificial grass sports fibres 2, 2', 2", 2''' are attached.

FIGS. 3*a* and 3*b* likewise show the artificial grass sports fibres 2 attached to the carrier 1. In this embodiment the artificial grass sports field comprises several groups of artificial grass sports fibres 2-2'-2", each having a different function. According to the invention, in particular the artificial grass sports fibres 2" comprise at least one additional material component, which material component imposes a permanent volume increase on the fibre 2" under the influence of an external stimulus.

This is clearly shown in FIGS. 3*a* and 3*b*, with FIG. 3*a* showing the situation in which the artificial grass sports fibres 2" have according to the invention been attached in or to the carrier 1, using a technique that is known per se, such as tufting, weaving or knitting, even before the transformation to the permanent volume increase. Said permanent volume increase must preferably take place after the artificial lawn has been produced, cf. the situation shown in FIG. 3*a*. As a result of the permanent volume increase, the artificial lawn has been transformed to the situation shown in FIG. 3*b*.

In FIG. 3*b* the artificial grass fibres 2" have undergone a permanent volume increase as a result of the presence of the additional material component, so that they fill the free spaces between the artificial grass fibres 2. The artificial grass fibres 2" that have undergone a permanent volume increase after the aforesaid transformation and under the influence of an external stimulus thus form a resilient or damping layer indicated at ii in FIG. 3*b*, whilst the other groups of artificial grass fibres 2 and 2' extend above the group of artificial grass sports fibres 2". This is indicated at i in FIG. 3*b*.

In a preferred embodiment it is preferable if the additional material component, which imposes a permanent volume increase on the artificial grass fibre under the influence of an external stimulus is homogeneously distributed in the fibre. Thus it is possible to locally realise a fibre having an increased volume, which can function as a resilient or damping layer.

In another preferred embodiment it is preferable if the additional material component, which imposes a permanent volume increase on the artificial grass fibre under the influence of an external stimulus, is locally distributed in the fibre by co-extrusion. Thus it is possible to realise a very specific local volume increase in the fibre, which can give the fibre additional pile recovery capability in addition to damping properties.

The additional material component is preferably a foam material, which foam material may in particular be composed of a mixture consisting of at least one or several polymeric materials combined with at least one chemical blowing agent that is compatible with said mixture. Examples of chemical foam materials (also called blowing agents) suitable for this invention are Azo, Hydrazide, Carbazides, Tetrazoles, Nitroso compounds and carbonates. More specifically, the foam material has a closed cell foam structure, although it is also possible to use an open cell foam structure. A closed cell structure is preferred, however, because the foamed material (i.e. after the volume increase) will thus be hardly affected by, for example, the weather conditions and dirt. A closed cell foam structure is for example insensitive to sub-zero temperatures, dirt and moisture, so that it is ensured that the playing characteristics and the playing behaviour will remain the same, also when the artificial lawn is used for playing sports in varying weather conditions.

Furthermore an embodiment of the artificial grass sports field is shown in which several groups of artificial grass fibres. 2-2'-2" are used, wherein the artificial grass fibres 2" of at least a first group are likewise provided with an additional material component, which imposes a permanent volume increase on at least the artificial grass sports fibre under the influence of an external stimulus.

The two situations are shown in FIGS. 3*a* and 3*b*, with FIG. 3*a* showing the situation in which the artificial mat has just been constructed, whilst FIG. 3*b* shows the situation in which a permanent volume increase has been imposed on at least the first group of artificial grass sports fibres 2" under the influence of an external stimulus (for example heat), so that said first group forms an additional damping layer indicated at ii, wherein the artificial grass fibres 2" of the first group are disposed between the artificial grass sports fibres 2 of a second group and the artificial grass sports fibres 2' of a third group.

The artificial grass sports fibre 2" is preferably an extruded fibre, so that it is possible to produce said fibre by means of the existing production techniques. In view of the intensive loads to which the artificial grass fibres 2-2'-2" are subjected, it is furthermore preferable if in particular the artificial grass sports fibre 2" is a crosslinked fibre. Crosslinking provides an extra strong fibre, which does not wear or split easily in the case of intensive use. It is furthermore preferable to form the carrier 1 of crosslinked fibres as well. In addition to that it is preferable to use an extruded fibre as the artificial grass fibre, which can thus be produced by means of simple, known techniques.

In another embodiment at least the extruded artificial grass sports fibre 2" has been formed by co-extrusion of at least the basic synthetic material and the additional material component. Also other fibre groups may have been produced by co-extrusion, however. Thus it is possible to realise a layered artificial grass fibre by means of the co-extrusion step, with the different materials imparting different functionalities to the fibre. The basic synthetic material from which the artificial grass fibre is made thus functions to provide strength, for example, whilst the additional material component, which undergoes a permanent volume increase under the influence of an external stimulus, functions to provide for example damping or resilience.

The basic material (indicated "B" herein) may surround the additional material component (indicated "A") according to a BAB structure. In another embodiment, the artificial grass fibre may be built up of several layers realised by co-extrusion, wherein the additional material component is surrounded on at least two sides according to a BAB or BAC structure by two synthetic materials (indicated "B" and "C"), which may or may not be different from each other, so as to influence the surface properties of the artificial grass fibre. In yet another embodiment, the additional component A surrounds the basic material B on two or more sides according to an ABA structure, in order to thus create a strengthened, foamed artificial grass sports fibre.

According to the invention, the artificial grass fibre 2" can undergo the permanent volume increase under the influence of an external stimulus (for example heat). This makes it possible to build up the artificial grass sports field 10 of the various groups of artificial grass fibres, for example 2-2'-2", wherein the permanent volume increase has been imposed on the additional material component in the group of artificial grass sports fibre 2" by supplying heat, for example during the coating process. The artificial grass fibre 2" thus transforms, as shown in FIG. 3*b*, and provides a damping layer ii above the carrier 1 (indicated at iii).

FIG. 4 shows yet another embodiment of an artificial lawn comprising several groups of artificial grass fibres 2-2'-2"-2'". The group of fibres 2 concerns a fibre having an ABA (or BAB) structure as described above obtained by means of a co-extrusion process, which has a reduced friction coefficient on the outer side to provide good sliding characteristics and/or an improved pile recovery capability (resilience) during play. The fibres 2' are soft, composite monofilament fibres for filling up the playing surface. The fibre group 2" consists of foam fibres according to the invention, which have shock-absorbing properties, whilst the fibres 2'" are stiff fibres, which function to keep the field system open and prevent the artificial grass sports fibre from compacting.

The invention claimed is:

1. An artificial grass lawn for an artificial grass sports field, the lawn comprising a carrier to which a plurality of spaced-apart groups of artificial grass fibres are attached; wherein an artificial grass fibre of a first group has a height extending above the height of an artificial grass fibre of at least one further group, wherein the artificial fibres of both the first group and the at least one further group comprise at least one synthetic material, and wherein the artificial grass fibre of the at least one further group further comprises at least one additional material component not present in the first group, wherein the additional material component imposes a permanent volume increase on the artificial grass fibre of the at least one further group when the artificial grass fibre of the at least one further group is under the influence of an external stimulus exerted thereon to provide a damping layer to the artificial grass lawn.

2. The artificial grass lawn according to claim 1, wherein the additional material component is homogeneously distributed in the at least one further group of artificial grass fibre.

3. The artificial grass lawn according to claim 1, wherein the additional material component is a foam.

4. The artificial grass lawn according to claim 3, wherein the foam material comprises a mixture of at least one polymeric material and at least one chemical blowing agent that is compatible with said mixture.

5. The artificial grass lawn according to claim 3, wherein the foam material has a closed cell structure after the permanent volume increase.

6. The artificial grass lawn according to claim 1, wherein the synthetic material comprises a crosslinked artificial grass fibre.

7. The artificial grass lawn according to claim 1, wherein the artificial grass fibre is an extruded fibre.

8. The artificial grass lawn according to claim 7, wherein the extruded artificial grass fibre of the at least one further group is formed by co-extruding said at least one synthetic material and said additional material component.

9. The artificial grass lawn according to claim 8, wherein the grass fibre is layered and said at least one synthetic material surrounds said additional material component on at least two sides.

10. The artificial grass lawn according to claim 7, wherein the extruded synthetic grass fibre is formed by co-extruding said at least one synthetic material, said additional material component and a second synthetic material wherein the second synthetic material is the same or different from said one synthetic material.

11. The artificial grass lawn according to claim 1, wherein the additional material component imposes the permanent volume increase on the artificial grass fibre under the influence of heat.

12. The artificial grass lawn according to claim 1, in the form of a mat.

* * * * *